US007759662B2

(12) United States Patent
Komatsu et al.

(10) Patent No.: US 7,759,662 B2
(45) Date of Patent: Jul. 20, 2010

(54) FIELD ELECTRON EMISSION ELEMENT, A METHOD OF MANUFACTURING THE SAME AND A FIELD ELECTRON EMISSION METHOD USING SUCH AN ELEMENT AS WELL AS AN EMISSION/DISPLAY DEVICE EMPLOYING SUCH A FIELD ELECTRON EMISSION ELEMENT AND A METHOD OF MANUFACTURING THE SAME

(75) Inventors: Shojiro Komatsu, Tsukuba (JP); Toyohiro Chikyo, Tsukuba (JP); Katsuyuki Okada, Tsukuba (JP); Yusuke Moriyoshi, Tsukuba (JP)

(73) Assignee: National Institute For Materials Science, Tsukuba-shi, Ibaraki (JP)

( * ) Notice: Subject to any disclaimer, the term of this patent is extended or adjusted under 35 U.S.C. 154(b) by 367 days.

(21) Appl. No.: 11/792,995

(22) PCT Filed: Dec. 13, 2005

(86) PCT No.: PCT/JP2005/023203

§ 371 (c)(1),
(2), (4) Date: Jun. 14, 2007

(87) PCT Pub. No.: WO2006/064934

PCT Pub. Date: Jun. 22, 2006

(65) Prior Publication Data

US 2008/0122370 A1 May 29, 2008

(30) Foreign Application Priority Data

Dec. 14, 2004 (JP) ..... 2004-361146
Dec. 14, 2004 (JP) ..... 2004-361150

(51) Int. Cl.
*G21K 5/02* (2006.01)

(52) U.S. Cl. ..... 250/493.1; 313/306; 313/309

(58) Field of Classification Search ..... 250/205, 250/423 R, 424, 425, 427, 426, 423 P, 423 F, 250/492.1, 492.3, 493.1, 494.1; 313/309, 313/310, 311, 336, 351, 306, 483, 495
See application file for complete search history.

(56) References Cited

U.S. PATENT DOCUMENTS

| | | | | |
|---|---|---|---|---|
| 6,538,368 | B1 * | 3/2003 | Fox et al. | 313/311 |
| 6,744,208 | B2 * | 6/2004 | Kado et al. | 313/637 |
| 2003/0001490 | A1 * | 1/2003 | Yamamoto et al. | 313/495 |
| 2005/0018467 | A1 * | 1/2005 | Naaman et al. | 365/145 |
| 2005/0104504 | A1 * | 5/2005 | Takeuchi et al. | 313/495 |

FOREIGN PATENT DOCUMENTS

| | | |
|---|---|---|
| JP | H10-003869 | 1/1998 |
| JP | H10-050206 | 2/1998 |
| JP | H10-116555 | 5/1998 |
| JP | H10-269930 | 10/1998 |
| JP | 2001-250467 | 9/2001 |

OTHER PUBLICATIONS

Komatsu et al. "Electron Field Emission from Self-Organized Micro-Emitters of sp3-Bonded 5H Boron Nitride with Very High Current Density at Low Electric Field", Journal of Physical Chemistry B, 2004, 108 pp. 5182-5184.*

* cited by examiner

*Primary Examiner*—Jack I Berman
*Assistant Examiner*—Nicole Ippolito Rausch
(74) *Attorney, Agent, or Firm*—Manabu Kanesaka

(57) ABSTRACT

In an electron emission method, a voltage is applied to a field electron emission element that has a boron nitride material containing crystal, formed on an element substrate to show a conical projection of the boron nitride material and shows a stable electron emitting property in an atmosphere when a voltage is applied thereto to emit electrons. An electron emission threshold of the field electron emission element falls due to formation of a surface electric dipolar layer by bringing it into contact with an operating atmosphere containing polar solvent gas when applying a voltage to the field electron emission element so as to emit electrons.

7 Claims, 7 Drawing Sheets

FIELD ELECTRON EMISSION ELEMENT, A METHOD OF MANUFACTURING THE SAME AND A FIELD ELECTRON EMISSION METHOD USING SUCH AN ELEMENT AS WELL AS AN EMISSION/DISPLAY DEVICE EMPLOYING SUCH A FIELD ELECTRON EMISSION ELEMENT AND A METHOD OF MANUFACTURING THE SAME

TECHNICAL FIELD

The present invention relates to an electron emission method employing an element that is made of a material expressed by a general formula of BN and containing $sp^3$ bonds, $sp^2$ bonds or a mixture thereof and has a surface profile showing an excellent field electron emission characteristic that makes it capable of operating for field electron emission in the atmosphere.

More particularly, the present invention relates to an electron emission member having a unique configuration and showing an exceptionally remarkable field electron emission characteristic (of a current density of more than 1,000 times relative to similar conventional members) that has been developed with an objective of finding applications in the field of lamp type light source devices and field emission type displays using a field electron emission source and also to a method of manufacturing such an electron emission member.

Additionally, the present invention relates to an emission/display device that employs boron nitride expressed by a general formula of BN and having at least $sp^3$ bonds as cold cathode type electron source for electron emission. More particularly, the present invention relates to an emission/display device of the above identified type in which the electron source comprises boron nitride having a profile with pointed protrusions and an excellent field electron emission characteristic so that the device shows a low electron emission threshold value, a high output level and a long service life.

BACKGROUND ART

Liquid crystal displays and VFD (vacuum fluorescent displays) have been put to use in display sections of mobile phones and displays mounted in vehicles and electronic appliances in recent years. Research and development efforts have been and being paid for organic ELs as promising choice for such displays. However, they have respective disadvantages. More specifically, (1) since liquid crystal does not emit light spontaneously and requires a back light when used in a display, the display is inevitably complex and it is difficult to design an ultimately thin display and (2) VFDs intrinsically provide a low display resolution and hence can display only simple images, whereas (3) Organic ELs have not been commercialized because of the problem of service life that has not hitherto been dissolved yet and (4) LEDs are accompanied by a problem that they require to be bundled by a large number to form a structure when they are used as illumination/display devices and hence are not very convenient.

Massive research and development efforts have been and are being paid for field electron emission type displays as alternative displays. Field electron emission type displays include FEDs (field emission displays) and SEDs (surface-conduction electron-emitter displays). It is expected that these devices and related systems will be putting on significance more and more in the future. As a matter of fact, intensive research efforts are being paid for the purpose of improving devices and systems of the type under consideration and developing new field electron emitting materials.

Field electron emitting materials are required to show a low field electron emission threshold, a high withstand voltage and a high current density. Materials recently attracting attention as field electron emitting materials include carbon nano-tubes. However, carbon nano-tubes require improvement of the electron emitting performance and the current density when designing an electron emitting material on the basis of this material. Efforts are being paid for patterning nano-tubes in order to grow thin film out of them and processing them to produce a profile adapted to electron emission.

However, the process of manufacturing carbon nano-tubes has not been perfectly established and the technological development for processing them is still under way. In short, it is very difficult to realize a field electron emission display on the basis of carbon nano-tubes. Additionally, the current density that can be achieved by way of a cumbersome process of treating carbon nano-tubes is in the order of $mA/cm^2$ at most.

Carbon nano-tubes face a limit in terms of operating field intensity and problems such as degradation of material and exfoliation arise beyond the limit to make them undurable under hard operating conditions including a high voltage and a long operation time. While some reports say that displays using carbon nano-tubes are on the stage of experimental manufacture, the development of such displays is basically still in a difficult situation.

Field electron emission technologies are highly important. It will not be necessary to explain further that they influence not only specific technological fields but also the society at large and daily lives of ordinary people. Thus, more and more efforts will be paid for the development of field electron emission technologies. There is a strong demand for materials that can withstand a high field intensity and stably emit electrons with a high current density for a long period of time without degradation and damages.

The inventors of the present invention also have paid intensive research efforts in order to meet the demand and looked into boron nitride that is attracting attention as a heat-resistant and abrasion-resistant material. As a result of studies on electron emitting materials based on the compound, the inventors of the present invention came to find that boron nitride film that is prepared under certain conditions shows a surface profile that is remarkably good for emitting field electrons and withstands a high field intensity.

More specifically, the inventors of the present invention found that, in the process of producing and depositing boron nitride on a base (which may be flat plate-shaped, wiry, spherical or of some other shape) by way of a reaction from a gas phase, boron nitride of a certain bond type is formed as film on the base when ultraviolet rays are irradiated on and near the base with a high energy level and $sp^3$ bond type boron nitride is produced with a pointed profile and grown in a self-organizing manner in the direction of irradiation of rays at appropriate intervals and that the obtained film easily emits electrons when an electric field is applied to it and can stably maintain its condition and performance without being degraded, damaged and exfoliated, maintaining an exceptionally large current density. The inventors have already applied for a patent for the achievement (see Patent Documents 1 and 2).

Patent Document 1: Jpn. Pat. Appln. Laid-Open Publication No. 2004-35301

Patent Document 2: Jpn. Pat. Application No. 2003-209489

DISCLOSURE OF THE INVENTION

Problem to be Solved by the Invention

The present invention is an improvement to the conventional art disclosed in the above-cited patent documents. The problem to be solved by the present invention is to provide a field electron emission element that operate stably in the atmosphere, a method of manufacturing the same and a field electron emission method using such an element as well as an emission/display device employing a cold cathode type electron source having a surface profile showing an excellent field electron emission characteristic along with a low electron emission threshold value, a high output level and a long service life. More specifically, the present invention provides a field electron emission element that is formed in a self forming manner from a gas phase by way of a reaction, using a material expressed by a formula of BN that is produced according to the prior art so as to have a pointed profile and contain $sp^3$ bonds, $sp^2$ bonds or a mixture thereof, and operates well in the atmosphere to show an excellent electron emitting performance and an emission/display device comprising a cold cathode type electron source having a low electron emission threshold value, a high output level and a long service life.

Means for Solving the Problem

As a result of intensive research efforts for solving the above problem, the inventors of the present invention succeeded in developing an electron emission element that operates stably for electron emission in the atmosphere by utilizing boron nitride provided by the conventional art and having a specific physical surface profile so as to perform excellently for electron emission. The inventors also tried to use such boron nitride for FEDs and illuminations and as field electron emitting material that can be employed generally for emission/display devices. The inventors of the present invention kept on developing devices, expecting that emission/display devices showing a low electron emission threshold value, a high output level and a long service life can be realized by using such devices. As a result, the inventors of the present invention came to find that it is possible to prepare devices of an outstanding level if compared with the prior art. This invention is based on the finding and is defined as follows.

(1) A field electron emission element characterized in that it comprises a boron nitride material containing crystal that is formed on an element substrate to show a pointed profile and expressed by BN and that it shows a stable electron emitting property in the atmosphere when a voltage is applied thereto.

(2) The field electron emission element as defined in (1) above, characterized in that the boron nitride material containing crystal that has a pointed profile and is expressed by BN is formed in a self-forming manner on the element substrate at intervals and to a density suitable for electron emission.

(3) The field electron emission element as defined in (1) or (2) above, characterized in that the boron nitride material containing crystal that has a pointed profile and is expressed by BN is made of an $sp^3$ bond type BN, an $sp^2$ bond type BN or a mixture thereof.

(4) The field electron emission element as defined in one of (1) through (3) above, characterized in that the boron nitride material containing crystal that has a pointed profile and is expressed by BN is formed by a reaction from a gas phase when excited by ultraviolet rays.

(5) The field electron emission element as defined in one of (1) through (4) above, characterized in that the field electron emission element is employed for an emission/display device.

(6) The field electron emission element as defined in one of (1) through (4) above, characterized in that the field electron emission element is employed for an illumination device.

(7) A method of manufacturing a field electron emission element adapted to emit electrons stably in the atmosphere when a voltage is applied thereto, characterized by causing a dilute material gas of rare gas such as argon and/or helium, hydrogen or a mixture gas thereof to react by irradiating ultraviolet rays onto an electron emission element substrate held to a temperature level between room temperature and 1,300° C. in an atmosphere where boron source material gas and nitride source material gas are introduced to 0.0001 to 100 volume % relative to the dilute material gas under pressure of 0.001 to 760 Torr, causing or without causing plasma to be generated, and a boron nitride material containing crystal that has a pointed profile and is expressed by BN to be formed on the element substrate in a self-forming manner.

(8) The method of manufacturing a field electron emission element as defined in (7) above, characterized in that the boron nitride material containing crystal that has a pointed profile and is expressed by BN is made of an $sp^3$ bond type BN, or a mixture of the $sp^3$ bond type BN and an $sp^2$ bond type BN.

(9) An electron emission method, characterized by applying a voltage to the field electron emission element as defined in one of (1) through (6) above to make it emit electrons.

(10) The electron emission method as defined in (9) above, characterized in that the electron emitting property of the field electron emission element is improved by bringing the field electron emission element into contact with an actuating atmosphere containing polar solvent gas when making it emit electrons by applying a voltage to the field electron emission element.

(11) The electron emission method as defined in (10) above, characterized in that the polar solvent gas is water and/or alcohol.

(12) A cold cathode type emission/display device, characterized in that it comprises a boron nitride material containing crystal that is formed on an element substrate to show a pointed profile and expressed by BN as a field electron emission source necessary for exciting phosphor to emit light.

(13) The cold cathode type emission/display device as defined in (12) above, characterized in that the field electron emission source is a boron nitride material containing crystal that has a pointed profile and is expressed by EN and formed in a self-forming manner on the element substrate at intervals and to a density suitable for electron emission.

(14) The cold cathode type emission/display device as defined in (12) or (13) above, characterized in that the boron nitride material containing crystal that has a pointed profile and is expressed by BN is made of an $sp^3$ bond type BN, or a mixture of the $SP^3$ bond type BN and an $sp^2$ bond type BN.

(15) The cold cathode type emission/display device as defined in one of (12) through (14) above, characterized in that the boron nitride material containing crystal that has a pointed profile and is expressed by BN is formed by a reaction from a gas phase when excited by ultraviolet rays.

(16) The cold cathode type emission/display device as defined in one of (12) through (15) above, characterized in that the field electron emission source is arranged directly on, opposite to or separated from the phosphor in a container having a window and that light emitted from the phosphor is taken out from the window.

(17) The cold cathode type emission/display device as defined in (16) above, characterized in that the container is a vacuum container in the inside of which vacuum prevails.

(18) The cold cathode type emission/display device as defined in (16) or (17) above, characterized in that the phosphor is powdery or filmy.

(19) The cold cathode type emission/display device as defined in one of (16) through (18) above, characterized in that the phosphor is applied to the window.

(20) The cold cathode type emission/display device as defined in one of (16) through (19) above, characterized in that the phosphor is tricolor phosphor that emits RGB rays of light.

(21) A method of manufacturing a cold cathode type emission/display device, characterized by comprising: causing a dilute material gas of rare gas such as argon and/or helium, hydrogen or a mixture gas thereof to react by irradiating ultraviolet rays onto an electron emission element substrate held to a temperature level between room temperature and 1,300° C. in an atmosphere where boron source material gas and nitride source material gas are introduced to 0.0001 to 100 volume % relative to the dilute material gas under pressure of 0.001 to 760 Torr, causing or without causing plasma to be generated, and a boron nitride material containing crystal that has a pointed profile and is expressed by BN to be formed on the element substrate in a self-forming manner; taking out the reaction product from the reaction vessel with the substrate after the end of the reaction; and assembling the cold cathode type emission/display device, using the reaction product as field electron emission source.

(22) The method of manufacturing a cold cathode type emission/display device as defined in (21) above, characterized in that the boron nitride material containing crystal that has a pointed profile and is expressed by BN is made of an $sp^3$ bond type BN, or a mixture of the an $sp^3$ bond type BN and an $sp^2$ bond type BN.

For the surface profile of a field electron emission element showing an excellent field electron emission characteristic according to the present invention to be formed in a self-forming manner, it is necessary to be irradiated with ultraviolet rays at the time of the reaction from a gas phase. This is a fact that is made clear by the inventors of the present invention in the above-cited patent documents. As described in the above-cited patent documents, the inventors of the present invention believe that the following explanation holds true. As Ilya Prigogine (a Nobel Laureate) pointed out, surface morphosis by self-organization can be grasped as "Turing structure" that appears under certain conditions where a surface diffusion and a surface chemical reaction of a precursor substance take place conflictingly. In the case of the present invention, irradiation of ultraviolet rays participates in photochemically accelerating them and influences the regular distribution of initial cores. The growth reaction on the surface is accelerated by irradiation of ultraviolet rays. This means that the reaction speed is proportional to the intensity of irradiated ultraviolet rays. If the initial cores are assumed to be semi-spherical, the intensity of irradiated rays is high and the growth is accelerated at and near the apex, whereas the intensity of irradiated rays is low and the growth is retarded in the peripheral edge area. It may be safe to assume that this is one of the factors that produce a pointed surface profile. All in all, irradiation of ultraviolet rays takes a very important role and there will be no denying that it is very important.

For the purpose of the present invention, the expression of "showing a stable electron emitting property in the atmosphere" does not mean that a field electron emission element according to the present invention is to be used limitedly in the atmosphere in terms of conditions and modes of operation. The above expression means that a field electron emission element according to the present invention can operate properly without being held in a vacuum container, whereas it is difficult for conventional field electron emission elements to operate stably in the atmosphere and hence are normally held in a vacuum container and driven to operate in vacuum. Thus, the above expression does not mean that a field electron emission element according to the present invention needs to be used limitedly in the atmosphere. In other words, the modes of operation of a field electron emission element according to the present invention include those in a vacuum container as in the case of conventional elements as well as those in the atmosphere. Thus, a field electron emission element according to the present invention operates satisfactorily in the stage where crystal having a pointed profile and expressed by BN is formed on the element substrate and the present invention covers a field electron emission element in that stage of course, the present invention also covers a field electron emission element where the element substrate on which a boron nitride material that contains the crystal is formed is integrally combined with some other means to produce a unit or a module. Additionally, the present invention covers a field electron emission element in a state of being integrally fitted to the inside of a container, in which the atmosphere and the pressure may or may not be adjusted to vacuum.

ADVANTAGES OF THE INVENTION

Conventionally, the operation of drawing out electrons from a substance relies on the use of a field electron emitting material showing a high electron emission threshold value. In the case of cold cathode type devices, it is indispensable to apply a large voltage in vacuum, or in the case of thermal electron type, it is indispensable to heat the electron emitting material to a high temperature level not lower than 2,000° C. in vacuum. Devices that utilize electrons drawn out into a space require a costly special arrangement for containing the device in vacuum in a hermetically sealed condition. To the contrary, present invention provides a field electron emission element (field electron emitting material) that is a thin film formed on a substrate operating as an electronic member by irradiating it with ultraviolet rays, made of a material expressed by a general formula of BN and mainly containing $sp^3$ bonds or a mixture with $sp^2$ bonds and showing a pointed profile. A field electron emission element according to the present invention shows a remarkable property of having a low electron emission threshold value and being able to stably emit field electrons in the atmosphere simply by applying a voltage to it.

Additionally, advantages of the present invention include the following. When such a material is used for the electron source of a cold cathode type emission/display device, it is energy saving because it can be driven to start operating with ease and additionally, it is not degraded if used for a long time in severe operating conditions to consequently prolong the service life of the device because BN itself is a stable compound. Furthermore, when a thin film is formed by the material in a self-forming manner and incorporated into a device as an electron emitter, it is possible to simplify the structure of the device and the process of preparing the device to a great advantage of cost. Since the thin film part including the emitter has only a thickness of several to tens of several micrometers, it is possible to produce ultra-thin devices.

BRIEF DESCRIPTION OF THE DRAWINGS

FIG. 8(*b*) is a schematic conceptual illustration of the emission/display device (phosphor: ZnO.Zn powder) as obtained in Example 6, showing the structure thereof.

FIG. 8(*c*) is a schematic conceptual illustration of the emission/display device (RGB light emission element) as obtained in Example 7, showing the structure thereof.

FIG. 8(*d*) is a schematic conceptual illustration of the emission/display device (RGB light emission element) as obtained in Example 8, showing the structure thereof.

EXPLANATION OF REFERENCE SYMBOLS

Figure 1:
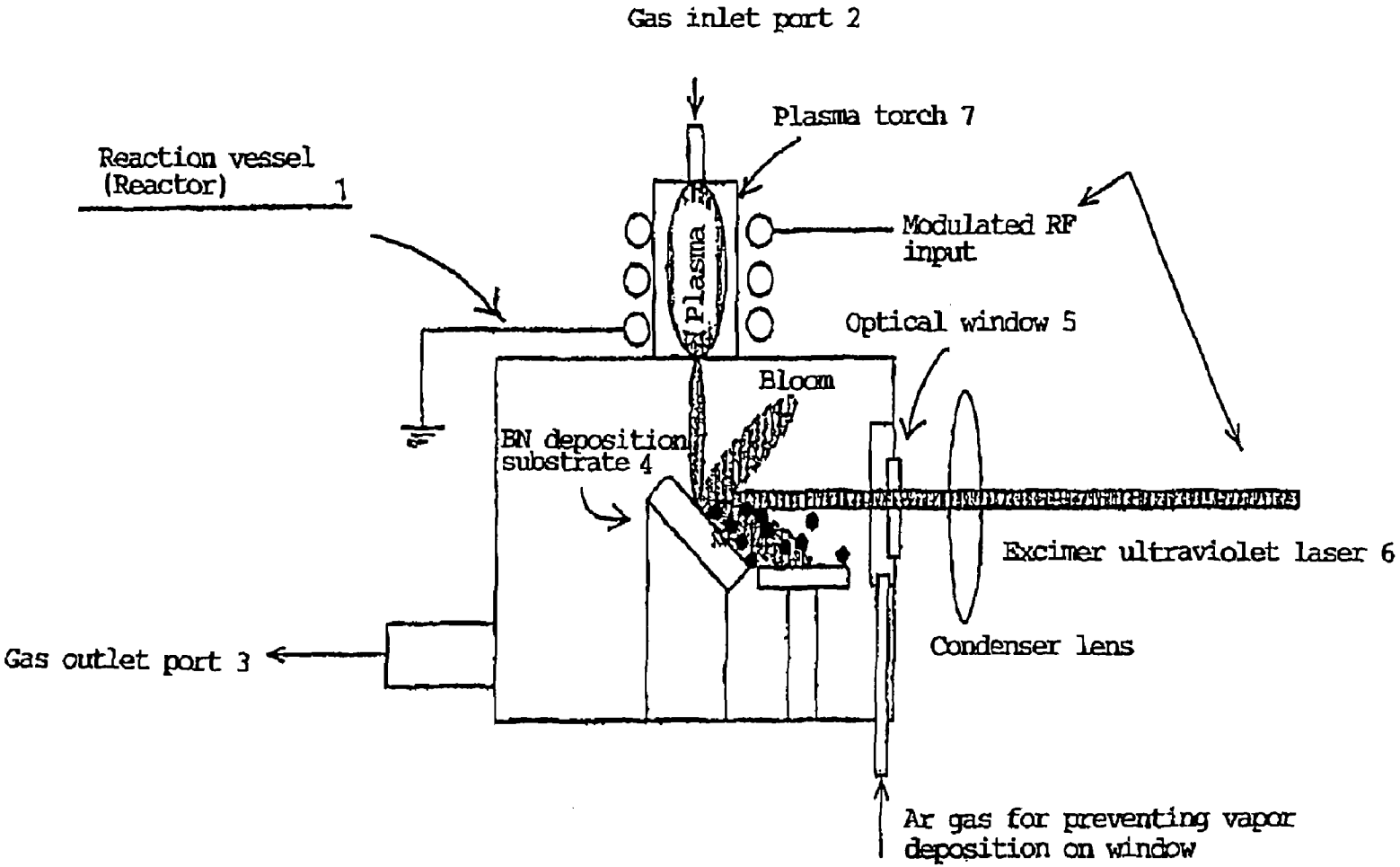
FIG. 1 is a schematic illustration of a reaction apparatus to be used for the purpose of the present invention.

1. reaction vessel (reactor)
2. gas inlet port
3. gas outlet port
4. boron nitride depositing substrate
5. optical window
6. excimer ultraviolet laser
7. plasma torch

BEST MODE FOR CARRYING OUT THE INVENTION

Now, the present invention will be described in greater detail by referring to the accompanying drawings and by way of examples.

A CVD reaction vessel having a structure as shown in FIG. 1 can be used for obtaining a boron nitride showing an excellent field electron emission characteristic and containing $sp^3$ bonds, or a mixture of the $sp^3$ bonds and $SP^2$ bonds.

Referring to FIG. 1, the reaction vessel 1 is equipped with a gas inlet port 2 for introducing reaction gas and dilute gas thereof and a gas outlet port 3 for discharging the introduced reaction gas and so on to the outside of the vessel and connected to a vacuum pump so that the internal pressure of the vessel is reduced and maintained to a level lower than that of the atmospheric pressure. A boron nitride depositing substrate 4 is arranged on the gas flow route in the vessel. An optical window 5 is fitted to part of a wall of the reaction vessel facing the substrate and an excimer ultraviolet laser 6 is arranged so as to irradiate the substrate with ultraviolet rays by way of the window.

The reaction gas introduced into the reaction vessel is excited by ultraviolet rays irradiated onto the surface of the substrate and the nitrogen source and the boron source in the reaction gas reacts with each other in a gas phase to produce boron nitride that is expressed by general formula BN and contains $sp^3$ bonds or a mixture with sp bonds. The produced boron nitride grows to become film. It has been made clear as a result of experiments that the reaction can proceed within a wide pressure range in the reaction vessel between 0.001 and 760 Torr and also within a wide temperature range of the substrate arranged in the reaction space between room temperature and 1,300° C., although the internal pressure and the substrate temperature in the reaction vessel is preferably low and high respectively to obtain a highly pure target reaction product. In a mode of carrying out the present invention, plasma is irradiated with ultraviolet rays to the surface of the substrate and a surrounding space region. The plasma torch 7 in FIG. 1 indicates this mode of carrying out the invention. As shown in FIG. 1, the reaction gas inlet port and the plasma torch are integrally arranged and directed to the substrate so that both reaction gas and plasma may be shot toward the substrate.

After the above-described synthetic reaction, the reaction product may be taken out with the substrate from the reaction vessel and arranged in an emission/display device so as to operate as electron emitter.

The invention of this patent application is carried out in a reaction vessel as described above. This will be described in greater detail by way of specific examples and by referring to the accompanying drawings. However, the examples described below are disclosed only to make the present invention easily understandable and by no means limit the present invention. As pointed out above, the object of the present invention is to provide a field electron emission element having a surface profile that shows an excellent field electron emission characteristic and is formed in a self-forming manner so as to mainly contain $sp^3$ bond type boron nitride or a mixture with $sp^2$ bond and a method of manufacturing the same. In other words, the reaction conditions may be appropriately selected and altered so long as the above object is achieved.

Another object of the present invention is to provide a cold cathode type emission/display device comprising an electron emission source formed by using a specific material and hence the reaction conditions may be appropriately selected and altered so long as the above object is achieved.

Now, the present invention will be described in greater detail by way of examples. However, as pointed out above, the examples described below are disclosed only to make the present invention easily understandable and by no means limit the present invention.

EXAMPLE 1

Diborane and ammonia were introduced with respective flow rates of 5 sccm and 10 sccm into a dilute gas flow of argon having a flow rate of 3 SLM. At the same time, excimer ultraviolet rays were irradiated onto a disk-shaped nickel substrate having a diameter of 25 mm and heated to a temperature level of 900° C. in an atmosphere where the pressure was reduced to 10 Torr by means of a pump (see FIG. 1). At this time, the gas was turned into plasma in an inductively coupled manner due to an electric field of 13.56 MHz (it is known that a similar morphosis takes place to produce an excellent field electron emission characteristic if the gas is not turned into plasma, although the growth rate may be affected by the extent of morphosis) The target substance was obtained after a synthesis time of sixty minutes. The crystal system of the specimen was a hexagonal system as determined by X-ray diffractometry and the specimen showed a 5H polygonal structure due to $sp^3$ bonds. The lattice constants of the specimen were a=2.50 Å and c=10.40 Å.

Figure 2:
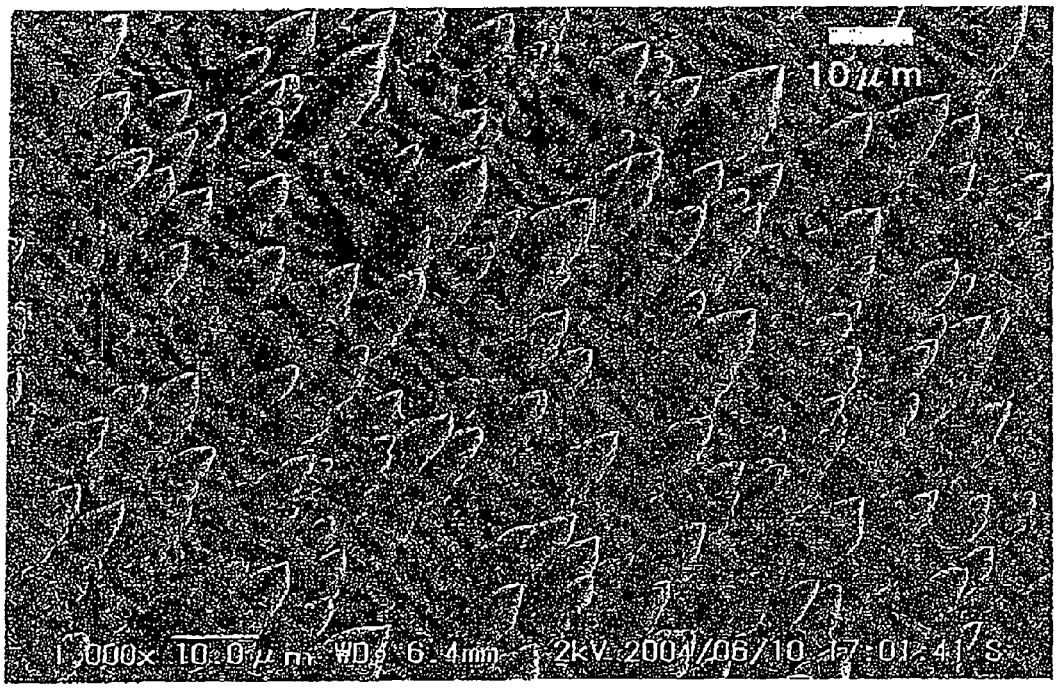
FIG. 2 is an image of the pointed BN crystal made to appear on the background of a thin film and deposited with an appropriate density in an appropriately dispersed state to show a particular surface profile as obtained by way of a scanning electron microscope in Example 1.

As a result, it was confirmed through a scanning electronic microscope (FIG. 2) that the thin film of the obtained substance showed a peculiar surface profile that had been formed in a self-forming manner and was covered by a structure having pointed conical projections (that were several to tens of several micrometers long) apt to produce a concentrated electric field.

Figure 3:
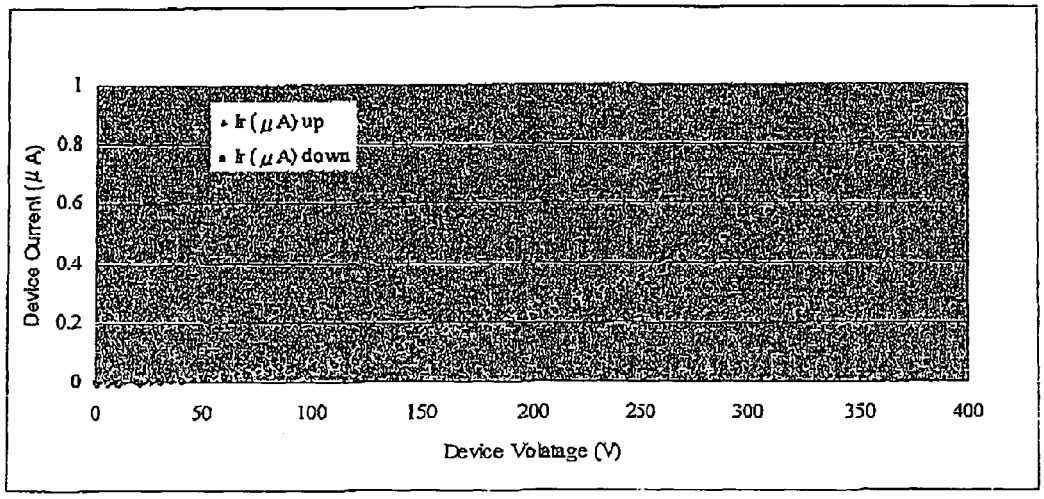
FIG. 3 is a graph showing the field electron emission characteristic of the element under 1 atmospheric pressure as obtained in Example 1.

The field electron emission characteristic of the thin film was examined in the following way. A piece of ITO glass was selected as anode and the specimen (thin film) was used as cathode. The two electrodes were separated from each other with a gap of about 40 micrometers and a voltage was applied to the electrodes to observe the rate of electron emission in the atmosphere. The electrically conductive side of the ITO was made to face the specimen. FIG. 3 summarily shows the obtained results. As seen from FIG. 3, an electric current was discharged from the very beginning without any threshold and an electric current of 1 μA was observed in the atmosphere with a field intensity of about 10 V/μm. During 60 minutes of observation, the average electric current showed no decline, although the electric current fluctuated to a certain extent. A resistor of 1 MΩ was connected to the device to be observed in series in order to prevent the electric current from flowing to a large extent to the ITO electrode. Thus, the electric current can be adjusted by modifying the resistance value of the resistor.

Figure 4:
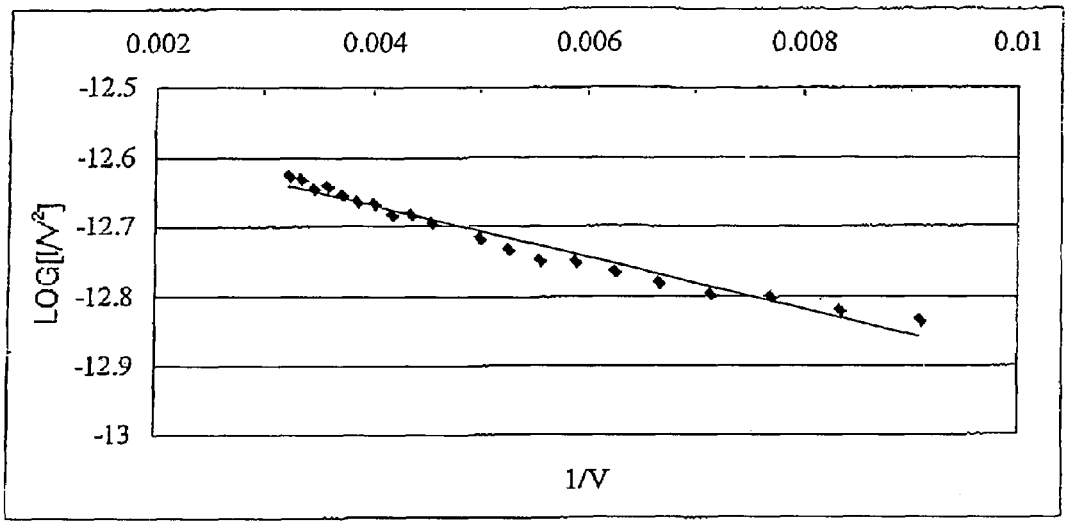
FIG. 4 is a Fowler-Nordheim plot of the field electron emission characteristic in vacuum as obtained in Example 1.

For the purpose of reference, a Fowler-Nordheim plot obtained as a result of conducting a similar experiment in vacuum is shown in FIG. 4. In FIG. 4, the horizontal axis indicates 1/V and the vertical axis indicates Log [I/V^2] (where V is the device voltage and I is the current value). It will be seen that the plotted points are substantially on a straight line to show that field electron emission took place in vacuum due to a quantum mechanical tunneling effect.

EXAMPLE 2

Figure 5:
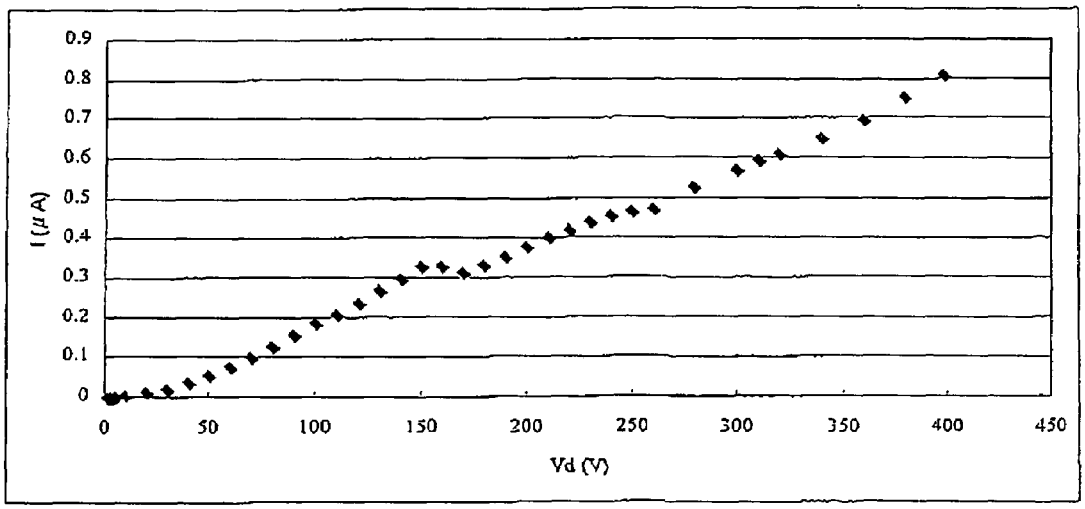
FIG. 5 is a graph showing the field electron emission characteristic of the element under 1 atmospheric pressure as obtained in Example 2.

ZnO:Zn fluorescent micro-particles were applied to the specimen (thin film) obtained in Example 1 to a thickness of about 10 μm and arranged vis-à-vis an anode of ITO glass with a gap of about 40 μm separating the surface of the specimen and the anode to prepare a field emission display (FED). A voltage was applied between the anode and the specimen, which was made to operate as cathode, and the rate of electron emission was observed in the atmosphere of 1 atmospheric pressure. Again, a resistor of 1 MΩ was connected to the device to be observed in series in order to prevent the electric current from flowing to a large extent to the ITO electrode. FIG. 5 summarily shows the obtained results. An emission of electrons that was as good as that of FIG. 4 was observed in the atmosphere.

EXAMPLE 3

Figure 6:
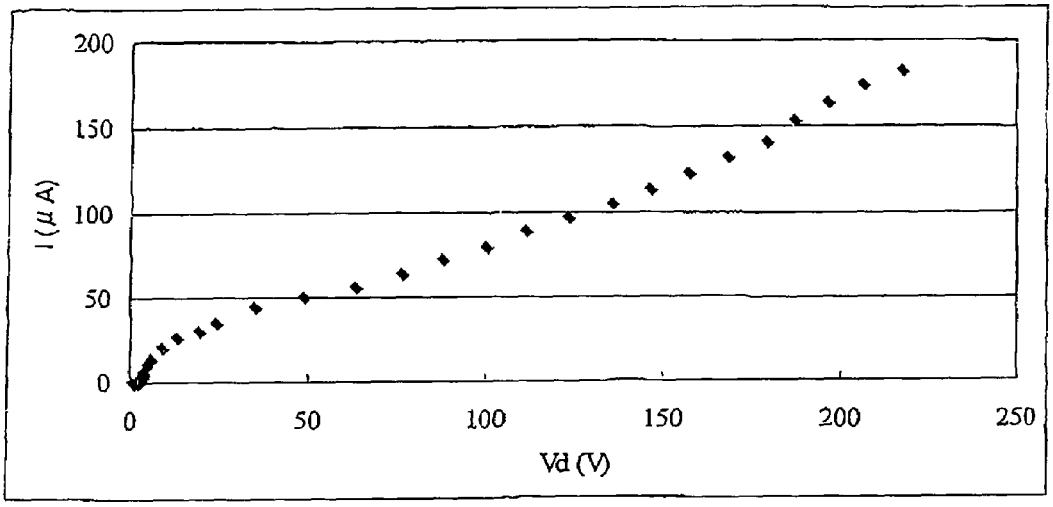
FIG. 6 is a graph showing the field electron emission characteristic of the element in the atmosphere (a moistened atmosphere) as obtained in Example 3.

An experiment similar to that of Example 2 was conducted in the atmosphere of 1 atmospheric pressure. However, a piece of sponge that was soaked with water was placed in the observation chamber so as to adjust the relative humidity of the air in the observation chamber to about 90%. FIG. 6 summarily shows the obtained results. It will be seen that the rate of electron emission and the electric current rose to about 200 times of those of Examples 1 and 2 due to the humidity adjustment of the operating atmosphere. While the inventors of the present invention believe that this is because of a fall of the electron emission threshold due to the formation of a surface electric dipolar layer by the water adsorbed to the surface, although the phenomenon needs to be looked into thoroughly by studies in the future. However, it is an empirically and experimentally proven fact that the electron emission characteristic can be improved by adjusting the humidity. In the Example, it is confirmed by a tester or the like that insulation between the anode and cathode is maintained.

EXAMPLE 4

Figure 7:
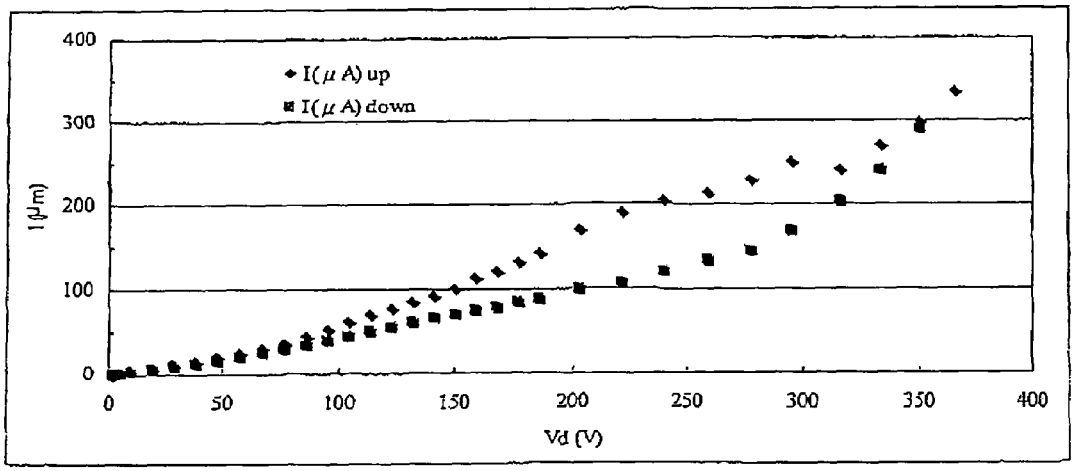
FIG. 7 is a graph showing the field electron emission characteristic of the element in the atmosphere (an ethyl-alcohol-added atmosphere) as obtained in Example 4.

An experiment similar to that of Example 2 was conducted in the atmosphere of 1 atmospheric pressure. However, a piece of sponge that was soaked with ethyl or methyl alcohol was placed in the sealed observation chamber so as to fill the inside of the observation chamber with alcohol-containing air. FIG. 7 summarily shows the obtained results. It will be seen that the rate of electron emission and the electric current rose to about 300 times of those of Examples 1 and 2 due to the addition of alcohol to the operating atmosphere. While the inventors of the present invention believe that the electron emission characteristic was improved because of fall of the electron emission threshold due to the formation of a surface electric dipolar layer by the water adsorbed to the surface. In other words, like water, alcohol tends to be polarized and shows a physical adsorption characteristic relative to the surface of BN so that the adsorption layer forms a surface charged double layer to facilitate electron emission, although the phenomenon needs to be looked into thoroughly by studies in the future. However, it is an empirically and experimentally proven fact that the electron emission characteristic can be improved by adding alcohol to the operating atmosphere.

EXAMPLE 5

Fluorescent micro-particles for forming a fluorescent display tube (ZnO:Zn particles) were applied to the specimen (thin film) obtained in Example 1 to a thickness of about 10 μm.

Figure 8:
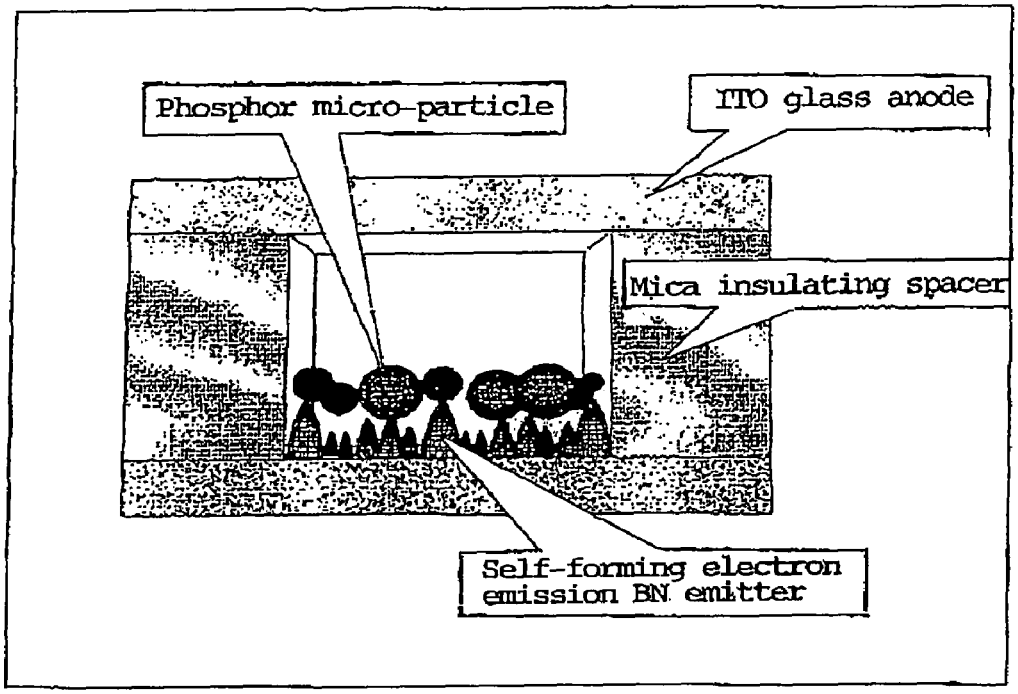
FIG. 8(*a*) is a schematic conceptual illustration of the emission/display device (phosphor: ZnO.Zn powder) as obtained in Example 5, showing the structure thereof.
Figure 8:
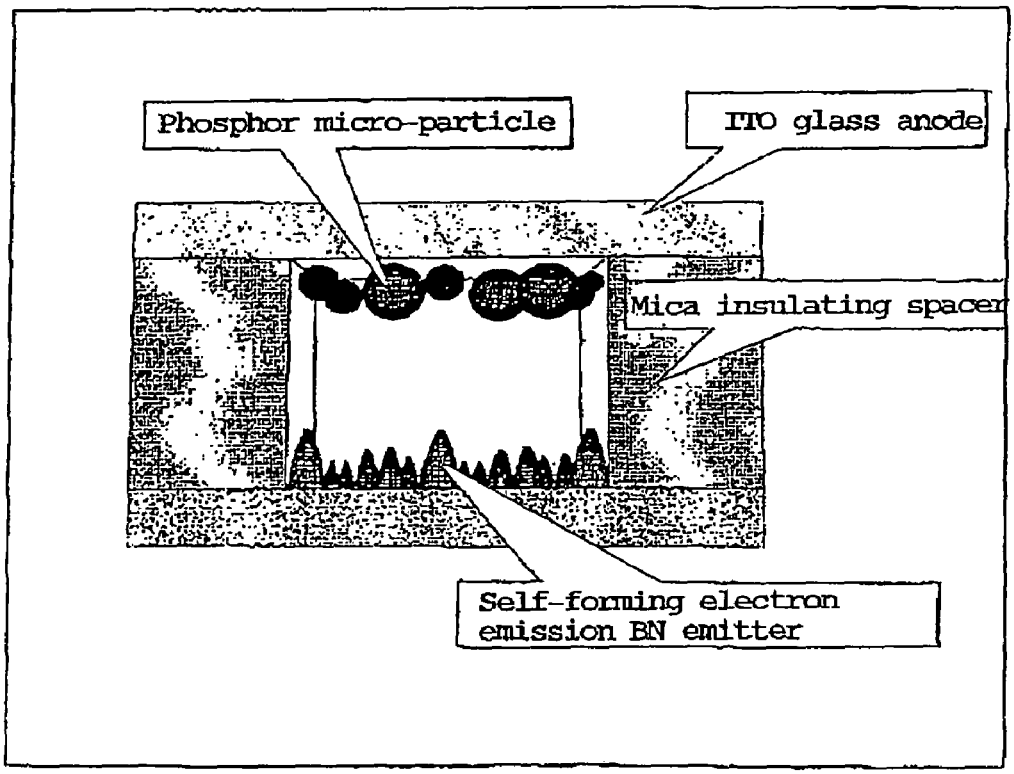
Figure 8:
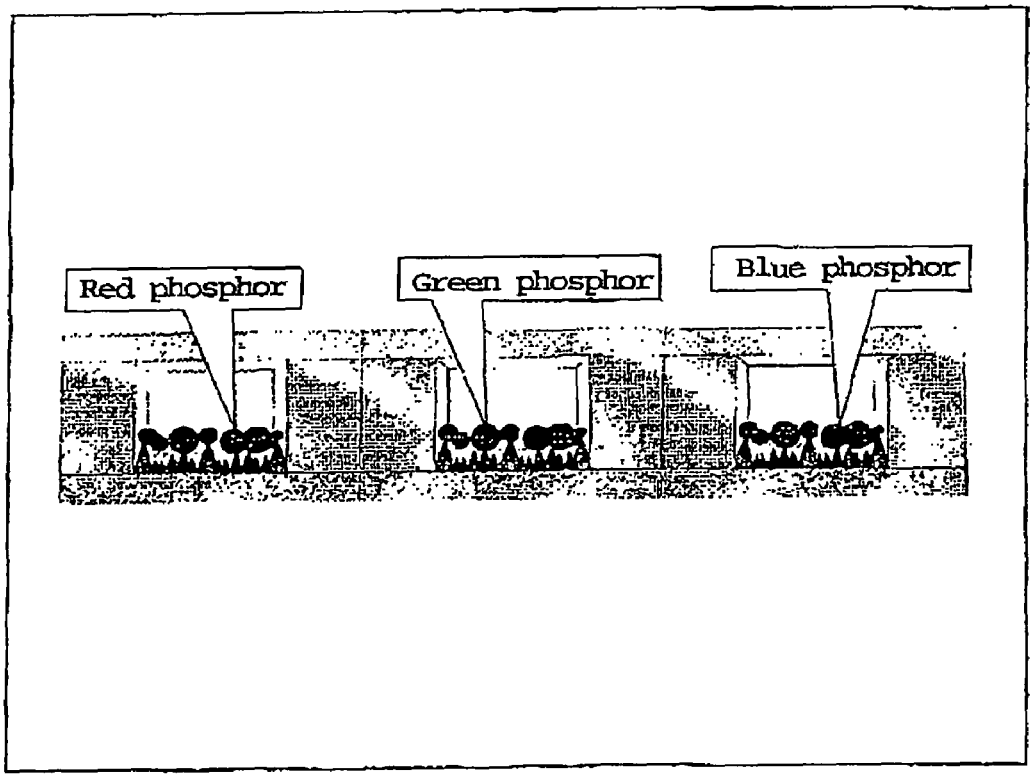
Figure 8:
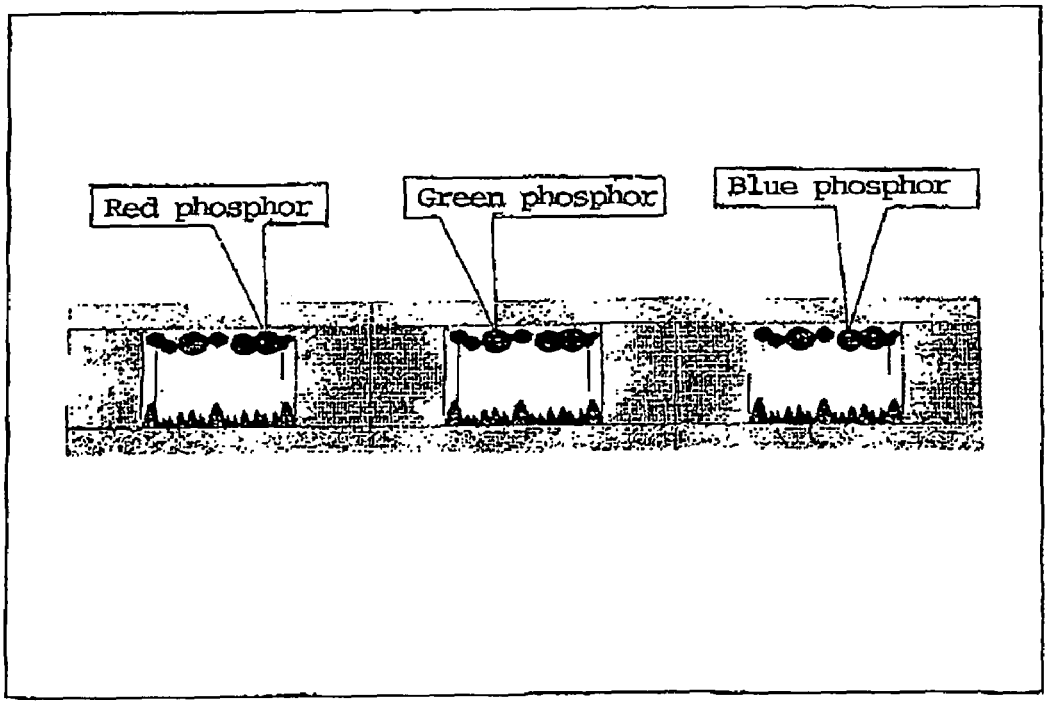

A device having a structure as illustrated in FIG. 8(*a*) was prepared in a manner as described below. Firstly, a 50 μm-thick piece of mica is arranged on the surface of the above-described thin film specimen coated with fluorescent micro-particles as an inter-electrode gap forming insulating spacer and a piece of ITO glass was placed thereon with the ITO surface facing the specimen. Thus, the ITO surface was made to operate as anode, whereas the specimen was made to operate as cathode. A gap of about 40 μm was provided between the surface of the fluorescent body directly applied to the cathode and the ITO surface that operated as anode.

Figure 9:
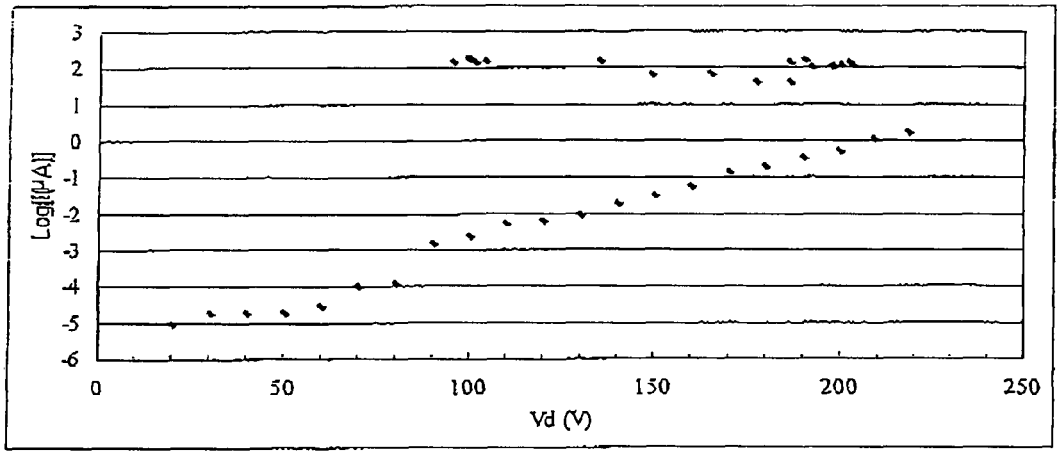
FIG. 9 is a graph illustrating the current-voltage characteristic of the device as obtained in Example 5.
Figure 10:
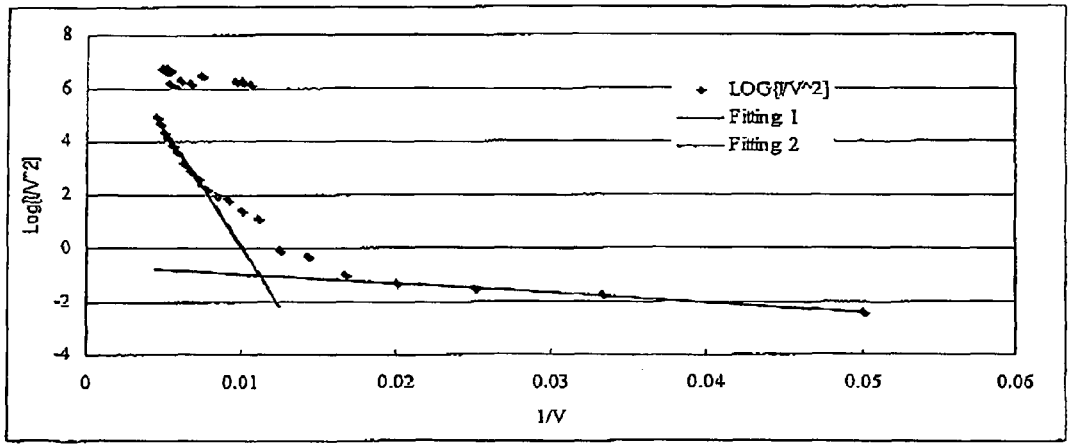
FIG. 10 is a Fowler-Nordheim plot of the data of FIG. 9.

FIG. 9 illustrates the current-voltage characteristic of the device prepared in the above-described manner in vacuum. A resistor of 1 MΩ was connected to the device to be observed in series in order to protect the device. In FIG. 9, the vertical axis indicates the logarithm of the electric current and the horizontal axis indicates the device voltage. Emitted light was observed with a range of device voltage between 100 and 200 V. It was confirmed that the range corresponds to the region surrounded by a dotted line in FIG. 9. FIG. 10 is a Fowler-Nordheim plot of the data of FIG. 9. In FIG. 10, the horizontal axis indicates 1/V and the vertical axis indicates Log [I/V^2], where V is the device voltage and I is the device current. It will be seen that the plotted points are substantially on a straight line to show that field electron emission took place in vacuum due to a quantum mechanical tunneling effect.

EXAMPLE 6

A specimen was prepared by using a substrate equivalent that of Example 5 in similar reaction conditions. Then, a piece of ITO glass was brought in and fluorescent micro-particles were applied to the ITO glass side. A light emission device was assembled from them with an insulating spacer of mica interposed between them and the specimen was made to operate as cathode, whereas the ITO glass was made to operate as anode in an experiment where the device was electrically energized under current-voltage conditions similar to those of Example 5 to find that the device similarly emitted light.

EXAMPLE 7

An RGB element was designed and prepared by combining devices, each being equivalent to that of Example 5, where three colors of green, blue and red fluorescent fine particles were respectively used. When applied a voltage, the device emitted light in RGB.

EXAMPLE 8

An RGB element was designed and prepared by combining devices, each being equivalent to that of Example 6, where three colors of green, blue and red fluorescent fine particles were respectively used. The device emitted light in RGB.

EXAMPLE 9

The ITO glass of each of the above examples was replaced by a 0.5 mm copper mesh plate (electrode) and a similar light emission effect was obtained.

As described above in detail, the present invention provides a field electron emission element having a surface profile that shows an excellent field electron emission characteristic and is made of a material formed in a self-forming manner so as to mainly contain $sp^3$ bond type BN or a mixture with $sp^2$ bond type BN and a method of manufacturing the same as well as an electron emission method using such an element. Thus, the present invention made it possible to provide a field electron emission element showing a low electron emission threshold value, a high current density and a long service life and hence has a great technological significance. The present invention also provides an emission/display device using the above-described material as field electron emission source and a method of manufacturing the same. Thus, the present invention can expectedly reduce the thickness and the weight of such devices to a great extent in the future.

The inventors of the present invention found a particular phenomenon that a thin film grows to show a peculiar profile in a self-organizing manner when irradiated with rays of light. The present invention is based on this finding. If the grown thin film itself is not processed (as grown), it shows a surface profile having a remarkable effect of accelerating the field electron emission performance. Additionally, such a thin film is practically not damaged by the electric discharge of the thin film material itself and maintains a high current density due to the physical characteristics of the material so that it shows a practically permanent service life in such an application. Thus, if compared with the prior art that requires processes for forming a profile and a pattern suitable for field electron emission, the significance of the present invention is not limited to the difference of process and the present invention provides a technology that intrinsically differs from the prior art. According to the present invention, there are provided a thin film that can emit field electrons with a constant current density of 1,000 times of the prior art, or of the order of $A/cm^2$, and is highly durable and a method of manufacturing the same as well as a broad scope of application due to the synergetic effect of the self-forming effect of the surface profile and the outstanding physical characteristics of the material itself. Thus, the present invention is a major breakthrough to the technological status quo and hence really epoch making.

INDUSTRIAL APPLICABILITY

As described above in detail, the present invention provides a field electron emission element having (a) a low field electron emission threshold value, (b) a high current density and (c) a long service life of electron emission. When it is used as an electron source in a cold cathode type emission/display device, it provides advantages including an easy startup, reduced weight and thickness of the device, a simplified assembly process and low cost in addition to the above identified advantages. In other words, the present invention can find a broad scope of application in the field of designing devices of the type under consideration. More specifically, the startup operation of such a device is satisfactory in the atmosphere that makes the performance of the device incomparable relative to the prior art. Particularly, since a field electron emission element according to the present invention is outstanding in terms of (b) and (c) above (a current density more than 1,000 times higher than that of the prior art and a strong and durable structure specific to BN) and hence provides a major technological breakthrough, it can find applications in various lamp type light source devices and field emission type displays that are required to show a high luminance level and to be free from material degradation if used for a long time in hostile operating conditions.

Conceivable applications of the present invention include ultra-high luminance and high efficiency lighting systems realized to emit electron rays with a current density of more than 1,000 times of the prior art, ultra-high definition displays realized by using the characteristic that a sufficient current value can be obtained with a micro-electron emission area (which will by turn find applications in portable phones, wearable computers and so on), formation of peculiar electron emission patterns by utilizing the electron emission characteristic that only the surface irradiated with ultraviolet rays during the growth period shows, ultra-high luminance nano electron sources and ultra-compact electron beam sources. The scope of application in the field of electronic devices and other technical fields is expected to further expand.

Consequently, the present invention will pave the way to technological innovations to various electric appliances and devices that are ubiquitous in our modern daily lives. In short, the scope of applicability of the present invention is very broad and may cover all the areas of human life. Thus, the technological and economic effects of the present invention are global and huge.

The invention claimed is:

1. An electron emission method comprising:

applying a voltage to a field electron emission element that has a boron nitride material containing crystal, formed on an element substrate to have a conical projection of the boron nitride material and shows a stable electron emitting property in an atmosphere when a voltage is applied thereto to emit electrons, wherein an electron emission threshold of the field electron emission element falls due to formation of a surface electric dipolar layer by bringing it into contact with an operating atmosphere containing polar solvent gas when applying a voltage to the field electron emission element so as to emit electrons.

2. The electron emission method according to claim 1, wherein the boron nitride material containing the crystal that has the conical projection of the boron nitride is made of an $sp^3$ bond type boron nitride, or a mixture of the $sp^3$ bond type boron nitride and an $sp^2$ bond type boron nitride.

3. The electron emission method according to claim 1, wherein the boron nitride material containing the crystal that has the conical projection of the boron nitride is formed in a self-forming manner on the element substrate at intervals and to a density suitable for electron emission.

4. The electron emission method according to claim 3, wherein the boron nitride material containing the crystal that has the conical projection of the boron nitride is made of an $sp^3$ bond type boron nitride, or a mixture of an $sp^3$ bond type boron nitride and an $sp^2$ bond type boron nitride.

5. The electron emission method according to claim 1, wherein the polar solvent gas is water and/or alcohol.

6. The electron emission method according to claim 1, wherein the boron nitride material containing the crystal that has the conical projection of the boron nitride is formed by a reaction from a gas phase when excited by ultraviolet rays.

7. The electron emission method according to claim 6, wherein the polar solvent gas is water and/or alcohol.

* * * * *